United States Patent [19]

Orsini

[11] Patent Number: 5,027,539

[45] Date of Patent: Jul. 2, 1991

[54] POLE RESTRAINED KITE OR AIRFOIL

[76] Inventor: Jean F. Orsini, 4110 Fessenden St., NW., Washington, D.C. 20016

[21] Appl. No.: 413,298

[22] Filed: Sep. 27, 1989

[51] Int. Cl.[5] ..... G09F 19/08

[52] U.S. Cl. ..... 40/415; 40/413; 40/477; 244/155 R

[58] Field of Search ..... 446/176, 217; 40/411, 40/413, 415, 421, 422, 424, 591, 427; 244/155 R, 155 A, 153 R

[56] References Cited

U.S. PATENT DOCUMENTS

| | | | |
|---|---|---|---|
| 1,441,261 | 1/1923 | Ackman, Jr. | 40/413 |
| 1,524,313 | 1/1925 | Rumohr | 40/415 |
| 1,531,566 | 3/1925 | Moiseve et al. | 40/413 |
| 1,666,806 | 4/1928 | Wright | 40/413 |
| 1,704,572 | 3/1929 | Masters | 40/477 |
| 2,637,928 | 5/1953 | Tufts | 40/415 |
| 3,105,663 | 10/1963 | Biddick, Jr. | 244/155 R |
| 3,116,902 | 1/1964 | Gould | 244/153 R |

FOREIGN PATENT DOCUMENTS

| | | | |
|---|---|---|---|
| 140259 | 3/1920 | United Kingdom | 40/415 |
| 176670 | 3/1922 | United Kingdom | 40/415 |

*Primary Examiner*—Joseph F. Peters, Jr.
*Assistant Examiner*—Christopher P. Ellis
*Attorney, Agent, or Firm*—Nixon & Vanderhye

[57] ABSTRACT

Kites and airfoils designed in such fashion that the possibilities to observe the process by which the kite or airfoil is made airborne are maximized.

Each time a gust of wind appears, the kite or airfoil rises automatically up a fixed pole which passes through it, without further direct intervention. When the airflow or wind abates, the kite or airfoil descends the pole, and rests on a restraining device located on the pole at a level higher than its lower-most level until the next gust of wind or an increase in the airflow lifts the kite or airfoil up again, and so on. The restriction of the pole also keeps the kite or airfoil within a short distance of the observer who can have a closer and better view of the process of ascension of the kite or airfoil up the pole.

The applications of this invention include scientific instruments, childrens's toys and advertising devices. One embodiment of the invention is a kite which is designed to use the radio antenna of an automobile as its pole.

8 Claims, 1 Drawing Sheet

POLE RESTRAINED KITE OR AIRFOIL

BACKGROUND AND SUMMARY OF THE INVENTION

Over several centuries kites and airfoils have been constructed and utilized for different purposes. Uses of these kites and airfoils have included children's toys, games, objects of art, scientific research instruments, rescue devices and machines of war. Some of the basic characteristics of kites and airfoils, exploited in these applications, were their capability of high-altitude flight, their manoeuverability, and their capacity to lift large weights. Different design configurations of kites and airfoils were developed to better fulfill the requirements for these various utilizations but the principal benefit of such kites and airfoils was mostly derived from what they could do once they were airborne.

However, one characteristic of great interest in airfoils and kites is their ability to be made to be airborne to begin with. This characteristic illustrates and verify a principle of physics: the airfoil principle.

Kites and airfoils according to the present invention are designed so that the possibilities of observing the process by which the kite or airfoil is made airborne are maximized. Each time a gust of wind appears, the kite or airfoil rises automatically up a fixed pole, without further direct intervention. When the airflow or wind abates, the kite or airfoil descends the pole, and remains lowered until the next gust of wind or an increase in the airflow lifts the kite or airfoil up again, and so on. The restriction of the pole also keeps the kite or airfoil within a short distance of the observer who can have a closer and better view of the process of ascension of the kite or airfoil up the pole.

The applications of this invention include scientific instruments—with meters to count wind gusts and the rate of lift occurences each time the kite or airfoil ascends or descends the pole and instruments measuring the force of the lift, children's toys and advertising devices. The advertising application of the pole-restrained kite or airfoil is derived from the fact that the ascending and descending movements of such kite or airfoil devices, when they are placed in a public location, catch the eye and draw the attention to whatever message is displayed on the kite or airfoil or on the structure on top of which or near which the device is placed.

The pole-restrained kite or airfoil according to the invention comprises a kite or airfoil of any adequate and known design and to which may be attached any decorative element, a pole—not necessarily erected in a perfectly vertical position and which may be mobile—which passes through the body of the kite or airfoil, a restraining device which prevents the kite or airfoil from flying off the pole, a blocking device at the lower part of the pole which prevents the kite or airfoil to descend to the very bottom of the pole. The purpose of the latter device is to make it possible for the air masses of the wind or airflow to come under the kite or airfoil, whenever they are present, and lift such kite or airfoil; otherwise, if the kite or airfoil were allowed to drop to the very bottom of the pole, the airflow would only flow over the kite or airfoil and not under it and therefore would not provide it any lift.

One primary object of the invention is a kite or airfoil restrained by the radio antenna of an automobile. Each time the automobile begins to move the kite or airfoil rises up the antenna. Each time the car slows down, to stop at a red light, for example, the kite or airfoil descends the antenna and rests on the lower restraining device. The purposes of such an application include a toy to amuse children watching from inside the car and a moving sign/advertising device for car owners who want to attract attention to the message written on the kite or airfoil (a movable bumper-sticker of sorts).

This and other objects of the invention will become clear from an inspection of the detailed description of the invention and from the appended claims.

DETAILED DESCRIPTION OF THE DRAWINGS

Figure 1:
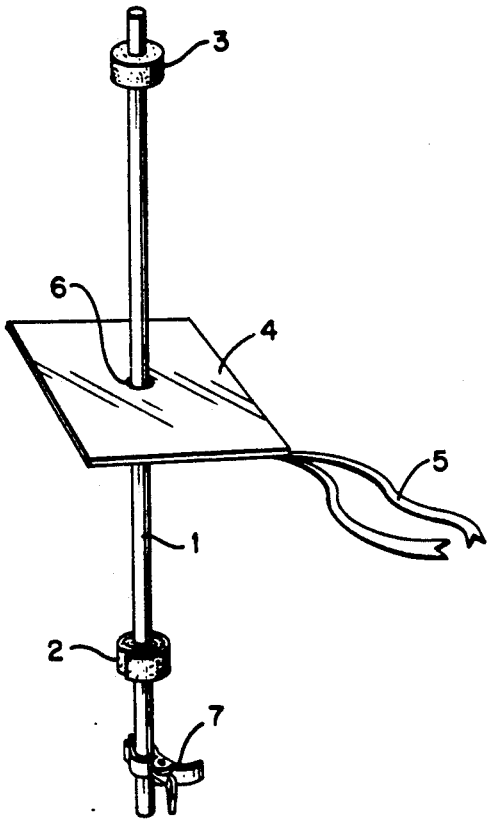
FIG. 1 is a perspective view of an exemplary device according to the present invention in which a kite configuration is utilized and a upper restraining device is affixed at the top of the pole. In this particular application the pole is a regular 2-feet high automobile antenna.
Figure 2:
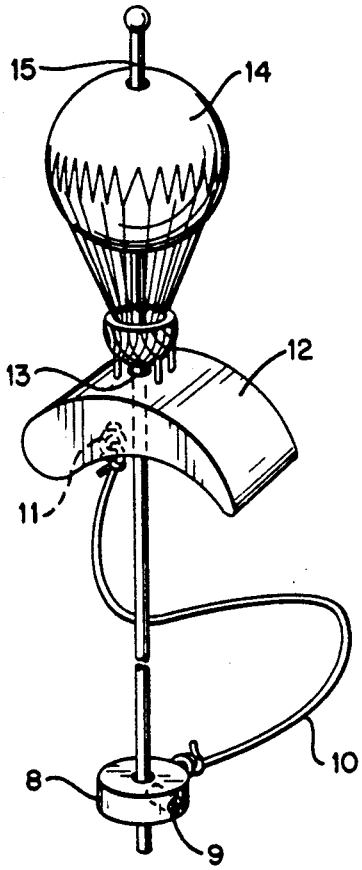
FIG. 2 is a perspective view of another possible form of the device with an airfoil configuration and a rope tether to restrain the ascension of the airfoil. In this particular application, the pole is a 30-feet high flag pole. A toy hot-air balloon is affixed to the airfoil for decorative and entertaining effects.

Basic elements of the pole-restrained kite or airfoil according to the present invention include the flying element (kite or airfoil) and restraining elements (string-tether or blocking apparatus). FIG. 1 and FIG. 2 present two basic configurations according to the present invention.

In FIG. 1, the flying element 4 is a kite. In FIG. 2, the flying element 12 is an airfoil. FIG. 1 and FIG. 2 each illustrate two different applications of the invention.

In FIG. 1 the pole 1 is an automobile antenna, the flying device 4 is a kite and the upper restraining device 3 is a simple blocking apparatus which is temporarily affixed to the antenna to prevent the kite from flying off the antenna.

In FIG. 2 the pole 15 has the dimensions of a flag pole, the flying device 11 is an airfoil and the restraining device is a rope tied at one end to the airfoil at point 11 and, at the other end, to the lower restraining device 8.

Further different embodiments of the invention can include, in any combination, the different elements distributed among the two versions of the invention represented in FIG. 1 and FIG. 2. The antenna version can utilize an airfoil of proportional size, as well as a string retainer device to prevent the kite or airfoil from flying off the antenna. The flag pole version can utilize a kite, of proportional size, as well as a upper blocking device to prevent the kite or airfoil from flying off the flag pole.

The lower blocking device 2 in FIG. 1 consists of a self-sticking band of padding material attached to the antenna in a spiral configuration. The padding material holds the antenna tight and the restraining device is kept in position against the antenna. Another configuration for the restraining device is a block of non-metallic elastic material with a central aperture and which is pushed down the antenna starting from the very top of the antenna to its chosen location. A third embodiment is a similar elastic block but with a slit along one of its radiuses which is pushed onto the antenna through the slit, directly at the chosen position on the antenna. A fourth embodiment is a clamp-like device, shown in 7, which can be affixed to the antenna directly at the preferred location, quickly and with ease. In FIG. 1, devices 2 and 7 are redundant as only one of the two suffices.

In FIG. 1, the upper blocking device 3 is a rubber block perforated in its center and pulled down the antenna to its chosen position but it could also be a rubber block with a slit aperture along a radius, or a clamp, or a self-sticking padded band. To the rear part of the main body of the kite 4 a tail 5 is attached which provides drag and proper positioning of the kite toward the incoming airflow according to the known function of kite tails. In 6 an aperture in the front-to-rear axis of the kite allows the antenna to pass through it.

Figure 3:
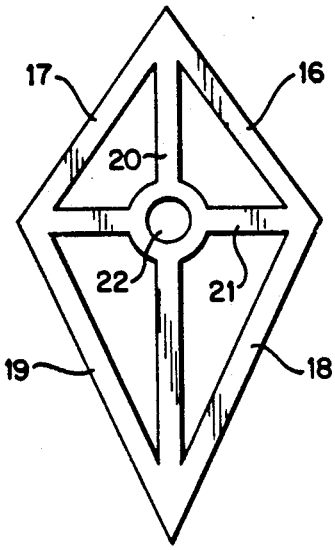
FIG. 3 is a top view of an embodiment of the framework of the kite portion of the device represented in FIG. 1.

In FIG. 2, the lower blocking device 8 is a ring-shaped element maintained in place on the pole by a simple device, here a screw, 9. Larger embodiments of the invention are indeed more permanent than the smaller embodiments and can incorporate devices, such as screws or dowels, which can be of a more permanent nature than clamps. To this blocking device a rope-tether 10 is attached. At its other end, this rope-tether is attached to the airfoil 12 by a spur 11 incorporated in the airfoil. The airfoil is drilled through in 13 leaving an aperture which allows pole 15 to pass through said airfoil. The rope-tether is shorter in length than the distance between its lower point of attachment of the rope and the bottom of the flying device when the upper part of the flying element (including decorative appendage) has reached the top of the pole. To the airfoil 13 is attached a decorative element, here a toy hot air balloon, 14, also transversed by the pole and which appears to be lifted up by itself with each gust of wind, when it is the effect of the wind on the airfoil 13 to which it is attached which really causes the ascending movement of the toy hot air balloon. FIG. 3 shows one preferred embodiment of the framework of the kite version of the antenna application of the invention. This framework is molded or, preferably die-cut in a sheet of material about 1/18 th of an inch in thickness. Such material can be man-made. After the cut is made, two shorter front sides of the kite's framework in 16 and 17 and the two longer back side of the kite's framework 18 and 19 are apparent. A cross-shaped structure is also left in the framework, after the die-cut, representing the front-to-rear axis 20 of the kite and the right-to-left axis 21 of the kite. In the center of the cross-shaped structure, an aperture 22 is provided in the framework for the antenna to pass through.

A thin flexible material (not shown), such as plastic film, is affixed on the kite framework which covers it completely. This thin material has an aperture provided on it corresponding to aperture 22 of the framework. The thin flexible material will be glued to, sewed over or, preferably, heat-sealed on the framework.

Figure 4:
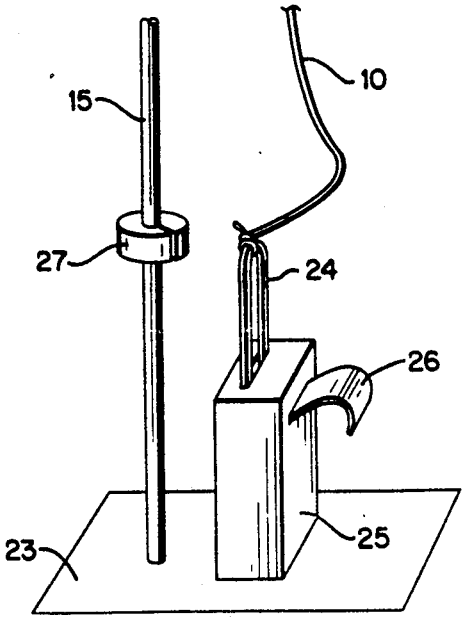
FIG. 4 is a perspective view of the lower portion of an embodiment of the invention designed as a scientific instrument.

In FIG. 4, the rope-tether 10 of the upper device restraining the kite or airfoil is attached to an instrument box 25, and specifically to the hook 24 of a dynamometer. The box also contains a clock which may be mechanical or electronic and a registering and/or writing device, here with paper tape 26 sticking out of the box. Pole 15 and instrument box 25 are affixed to a common base 23. The system still requires another lower restraining device 27, here an elastic block with a slit aperture.

It will thus be seen that according to the present invention a simple and effective flying device demonstrating and illustrating the airfoil principle has been provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A kite for ascending and descending movement along a generally vertically extending pole when said kite is disposed in an airstream, comprising:

a generally diamond-shaped kite body having a frame extending in a plane and defining longitudinal and transversely extending axes, said frame including a pair of front frame members diverging rearwardly from a forward apex located along the longitudinal axis of said kite frame and lysin on opposite sides of said longitudinal axis;

a pair of rear frame members connected to the front frame members adjacent their rearmost ends and converging rearwardly to join one another at a rear apex located along the longitudinal axis of said kite frame, said rear frame members extending along opposite sides of said longitudinal axis and defining side apices with said front frame members on opposite sides of said frame, said transverse axis extending between said side apices;

a first support member extending inwardly from a pair of said frame members and defining an opening therebetween generally coincident with said longitudinal axis for receiving the pole;

a second support member extending inwardly form a pair of said frame members, said first and second support members lying along the respective longitudinal and transverse axes of said kite frame and intersecting one with the other at said opening;

a film of thin flexible material carried by said frame and extending between said front and rear frame members; and a tail secured tot he frame adjacent the rear apex thereof for providing a drag force on the kite in the airstream.

2. A kite according to claim 1 wherein said film overlies one side of said frame and lies in a plane substantially parallel to the plane of said frame.

3. A kite according to claim 1 wherein said first support member is connected at opposite ends to said front and rear frame members at the respective rear and front apices, said second support member being joined at opposite ends to the connections between the front and rear members at opposite sides of the kite.

4. A kite according to claim 1 wherein said film overlies one side of said frame and lies in a plane substantially parallel to the plane of said frame, the area within said frame between said front and rear frame members and the support members being substantially open with said film overlying said open area on said one side thereof.

5. A kite according to claim 1 wherein said frame is formed of a plastic material and means including an adhesive for securing said film and said frame each to the other.

6. A kite according to claim 1 in combination with said pole, means carried by said pole above said kite for retaining said kite on said pole, and means below the kite for limiting movement along said pole in the descending direction to ensure flow of air below said kite.

7. A kite according to claim 6 wherein said retaining means comprises a block of non-metallic elastic material perforated in its center for receiving the pole, and means for locating said retaining means along said rod by a frictional compressive fit with said pole.

8. A kite according to claim 6 wherein said retaining means comprises a block of non-metallic elastic material slit along a radius for frictionally engaging about said pole.

* * * * *